United States Patent [19]

Barkan

[11] 4,064,383

[45] Dec. 20, 1977

[54] VACUUM CIRCUIT BREAKER WITH IMPROVED MEANS FOR LIMITING OVERTRAVEL OF MOVABLE CONTACT AT END OF OPENING STROKE

[75] Inventor: Philip Barkan, Media, Pa.

[73] Assignee: General Electric Company, Philadelphia, Pa.

[21] Appl. No.: 680,413

[22] Filed: Apr. 26, 1976

[51] Int. Cl.[2] ..... H01H 33/66

[52] U.S. Cl. ..... 200/144 B; 200/288; 200/153 H; 200/148 F

[58] Field of Search ..... 200/144 B, 148 F, 288, 200/153 H, 153 G

[56] References Cited

U.S. PATENT DOCUMENTS

| | | | |
|---|---|---|---|
| 3,163,735 | 12/1964 | Miller | 200/144 B |
| 3,180,960 | 4/1965 | Barkan et al. | 200/288 |
| 3,211,866 | 10/1965 | Crouch et al. | 200/144 B |
| 3,624,329 | 11/1971 | Fischer et al. | 200/148 F |
| 3,787,649 | 1/1974 | Goodwin, Jr. et al. | 200/153 H |

*Primary Examiner*—Robert S. Macon

*Attorney, Agent, or Firm*—William Freedman

[57] ABSTRACT

A vacuum-type circuit breaker comprises a conventional wipe mechanism interposed between an operating member and the movable contact of the breaker. The wipe mechanism comprises a driven part coupled to the movable contact, a driving part coupled to the operating member but movable with respect thereto, and preloaded spring means between said driving and driven parts.

First stop means is provided for stopping said operating member at the end of its circuit-breaker opening stroke with such abruptness that said driven member, against the opposition of said spring means, overruns the driving member following such stopping. Such overrunning of the driven member is limited by second stop means comprising a stop carried by said operating member. This stop engages the driven member and thus blocks said overrunning after a limited amount of such overrunning sufficiently low to prevent damage to the usual bellows of the vacuum circuit breaker despite thousands of excursions of the driven member through said overrunning travel.

10 Claims, 5 Drawing Figures

15
12
24
20
14
10
22
28
29
16
26
17
52
60
68
56
2
50
42
34
66
65
54
32
57
62
48
40
72
76
38
70
78
44
TO CLOSE
30
37
36
46
2
48

VACUUM CIRCUIT BREAKER WITH IMPROVED MEANS FOR LIMITING OVERTRAVEL OF MOVABLE CONTACT AT END OF OPENING STROKE

BACKGROUND

This invention relates to a vacuum-type circuit breaker and, more particularly, to means for limiting overtravel of the movable contact of such a circuit breaker at the end of an opening stroke.

The invention also relates to means for dissipating the kinetic energy remaining in the parts of a circuit breaker at the end of a closing operating. This energydissipating feature is usable in other types of circuit breakers as well as the vacuum-type circuit breaker.

The usual vacuum-circuit breaker comprises a contact wipe mechanism between the movable contact of the circuit breaker and the operating linkage for the contacts. This wipe mechanism serves to provide a desired hold-closed force on the contacts despite contact-wear and also to provide for an impact to the movable contact at the start of an opening operation. This wipe mechanism typically comprises a preloaded spring which is further loaded by wipe travel of the operating linkage at the end of the closing stroke after the contacts have engaged. The presence of this wipe mechanism introduces certain problems with respect to termination of an opening stroke. Such problems will be apparent from the following discussion.

More specifically, it is conventional practice to provide an opening dashpot which acts to smoothly and gradually terminate opening motion of the circuit-breaker operating linkage after it has driven the movable contact through an opening stroke. This dashpot is usually designed in such a way that it can terminate opening motion with deceleration forces that are limited to a value less than the preload in the wipe spring, and this relationship prevents the movable contact from overrunning the operating linkage when opening motion of the operating linkage is terminated. But if, for any reason, the opening dashpot should fail, the above-described overrunning of the movable contact can occur, and this can result in significant overtravel and resultant damage to the usual bellows of the vacuum interrupter present in the circuit breaker.

Consideration has been given to overcoming this overrunning problem by providing a stop between the relatively movable parts of the wipe mechanism that acts to block contact overtravel at the end of the opening stroke. But this approach is not feasible in the usual wipe mechanism since such a stop would interfere with the essential overtravel needed at the end of the closing stroke for wipe action.

Another possible way of overcoming the above-described overrunning problem is to provide an opening stop for the movable contact fixed to a stationary frame of the circuit breaker. Such a stop requires cumbersome support structure; and in the circuit breaker I am concerned with, there is no space available for such support structure.

SUMMARY

An object of my invention is to provide simple and compact means for safely limiting overrunning of the movable contact of the vacuum-type circuit breaker at the end of an opening stroke, which means does not interfere with or enter into a closing operation.

Another object is to accomplish the objective of the immediately-preceding paragraph without requiring: (a) an opening dashpot for smoothly terminating opening motion of the operating linkage, or (b) a stationary stop for the movable contact that requires cumbersome support structure for mounting the stop on the stationary frame of the circuit breaker.

Another object is to accomplish the first object set forth above with means that is easily accessible for accurate adjustment, thus allowing the amount of overrunning to be easily and precisely controlled.

Another object is to provide simple opening stop means that is exceptionally effective in dissipating excess opening energy, performing such energy-dissipation through a transverse scrubbing action.

Still another object is to provide opening stop means capable of performing as in the immediately-preceding paragraph and also capable of acting without dependence upon a stationary stop.

In carrying out the invention in one form, I provide a vacuum-type circuit breaker having a wipe mechanism interposed between an operating member and the movable contact of the circuit breaker. This wipe mechanism comprises a driven part coupled to the movable contact of the breaker, a driving part coupled to said operating member and movable with respect thereto, and preloaded spring means between the driving and driven parts which yields to store energy when the driving part is driven through wipe travel after the contacts engage at the end of a closing stroke. The operating member is operable throgh an opening stroke to drive said driving member against the driven member, thereby imparting contactopening motion to the movable contact.

First stop means is provided for stopping said operating member at the end of its opening stroke with such abruptness that the driven member overruns the driving member following such stopping against the opposition of the preloaded spring means. Such overrunning of the driven member is limited by second stop means comprising a stop carried by said operating member. This stop engages the driven member and thus blocks said overrunning after a limited amount of such overrunning sufficiently low to prevent damage to the usual bellows of the vacuum breaker despite thousands of excursions of the driven member through said overrunning travel. The stop is carried on the operating member in such a location that the stop is spaced from the wipe mechanism during a closing operation.

DETAILED DESCRIPTION OF PREFERRED EMBODIMENT

Figure 1:
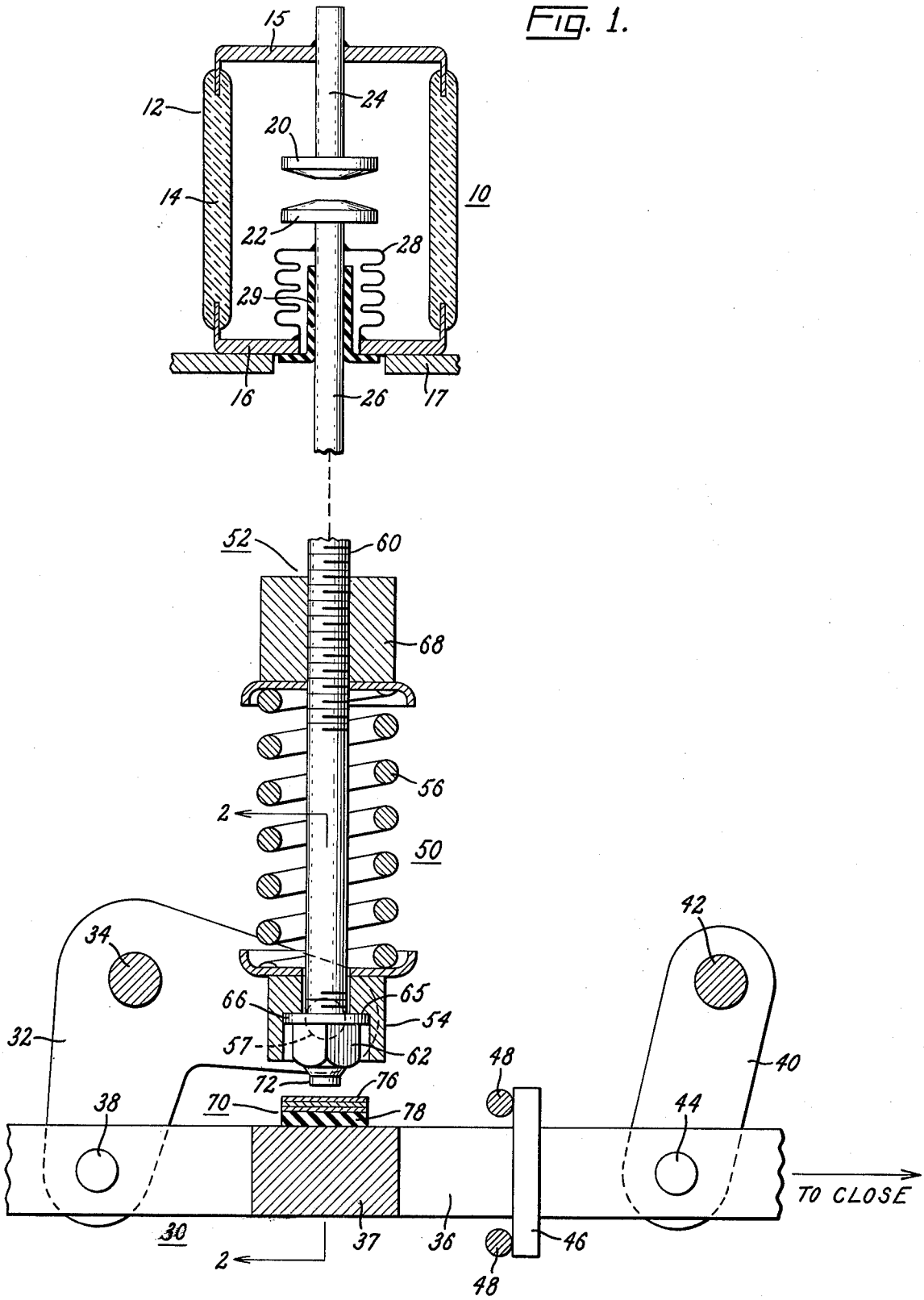
FIG. 1 is a side elevational view of a portion of a vacuum circuit breaker embodying one form of the invention. The circuit breaker is shown in its fully-open position.

Referring now to FIG. 1, the illustrated vacuum circuit breaker comprises a vacuum-type circuit interrupter 10 of conventional form. This circuit interrupter comprises an evacuated envelope 12 comprising a tubular casing 14 of insulating material and end caps 15 and 16 sealed to opposite ends of casing 14. The lower end cap 16 is suitably fixed to a stationary support 17.

Within the envelope are two separate contacts 20 and 22. Contact 20 is a stationary contact mounted on the lower end of the stationary contact rod 24 extending in sealed relationship through the upper end cap 15. Contact 22 is a movable contact mounted on the upper end of a movable contact rod 26 extending freely through the lower end cap 16. A flexible metallic bellows 28 is joined at its upper end to movable contact rod 26 and its lower end to end cap 16 to provide a seal about the movable contact rod that allows for vertical movement of the movable contact rod without impairing the vacuum inside envelope 12. A suitable guide 29 fixed to the lower end cap 16 slidably receives contact rod 26 and guides it for substantially straight-line vertical motion.

Figure 3:
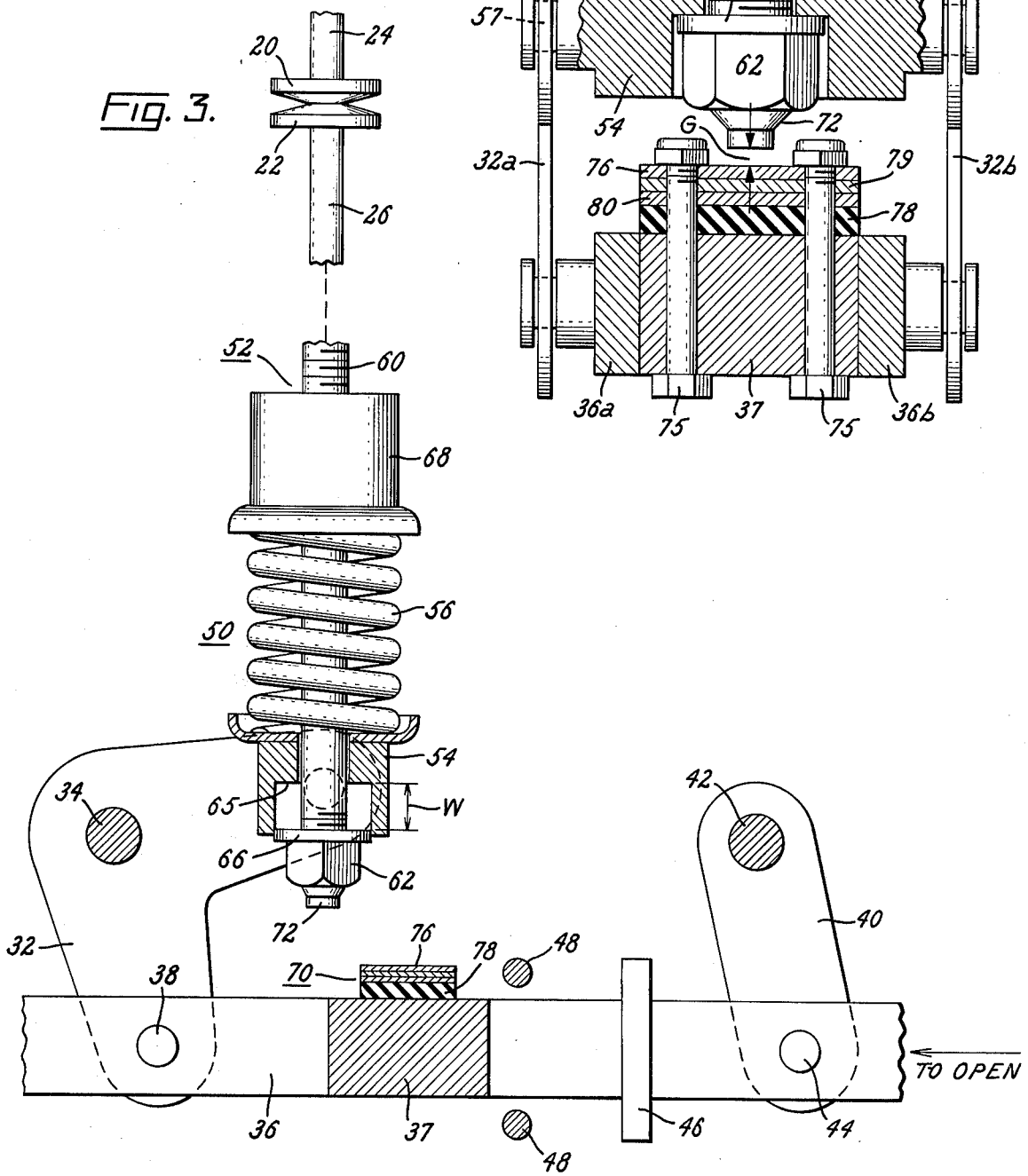
FIG. 3 is a view similar to that of FIG. 1 except showing the parts in the fully-closed position of the circuit breaker.

For operating the vacuum interrupter between its open position of FIG. 1 and its closed position of FIG. 3, an operating linkage 30 is provided. This operating linkage comprises a bell crank 32 having a stationary pivot 34 and an operating link 36 pivotally connected to one end of the bell crank through a pivot pin 38. Operating linkage 36 is guided for generally horizontal motion by bell crank 32 and by another crank 40 pivotally mounted on a stationary pivot pin 42. The lower end of crank 40 is pivotally connected to link 36 through a pivot pin 44. A suitable opening spring (not shown) holds the operating linkage 36 in its position of FIG. 1 when the interrupter is open. When in this position, a shoulder 46 fixed to operating link 36 abuts againt a stationary primary stop 48.

Figure 2:
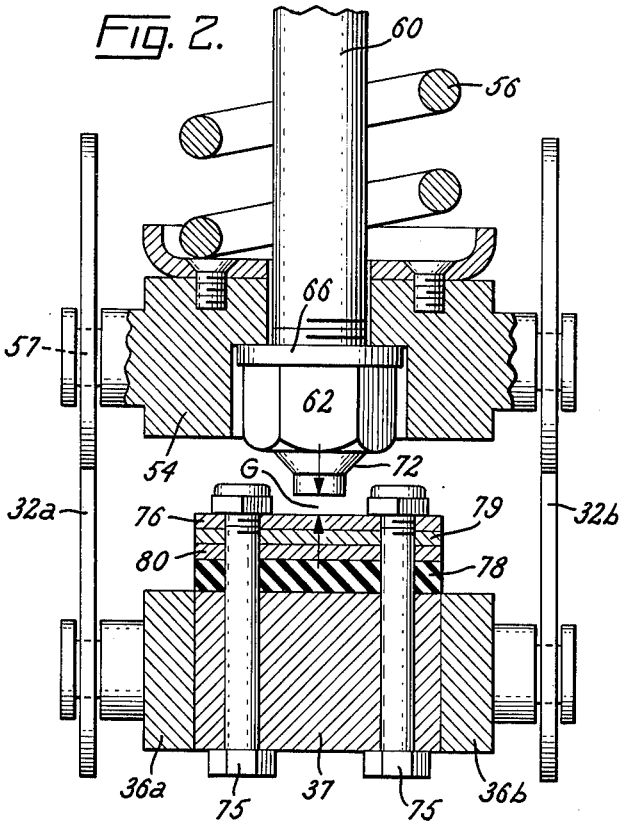
FIG. 2 is a sectional view along the line 2—2 of FIG. 1.

Operating link 36 comprises two side-by-side spaced segments **36*a* and 36*b*, best shown in FIG. 2. A spacer 37 is suitably clamped between the segments so that they are fixed with respect to each other and effectively constitute a single part 36. The bell crank 32 likewise is constituted by two side-by-side spaced segments 32*a* and 32*b* suitably clamped together, as best shown in FIG. 2**.

Closing of the interrupter is effected by driving operating link 36 to the right from its position of FIG. 1 into its position of FIG. 3. Such motion is produced by a suitable closing operator (not shown). Opening of the interrupter is effected by driving the operating link 36 to the left from its position of FIG. 3 into its position of FIG. 1. Such motion is produced by release of the usual opening spring (not shown).

For transmitting closing motion between bell crank 32 and the movable contact rod 26 of the interrupter, a wipe mechanism 50 is provided. This wipe mechanism comprises a driven part 52 suitably positively coupled to movable contact rod 26, a driving part 54 through which contact operating force from bell crank 32 is applied to the driven part 52, and a preloaded compression spring 56 between parts 52 and 54 through which driving force is transmitted from part 54 to part 52 during contact-closing motion. As shown in FIGS. 1 and 2, driving part 54 is pivotally connected to bell crank 32 by aligned trunions 57 at its opposite sides rotatably received in suitable openings in the bell-crank segments **32*a* and 32*b***.

The driven part 52 of the wipe mechanism comprises a rod 60 that is positively coupled to movable contact rod 26. Rod 60 has a threaded lower end receiving a nut 62 effectively fixed thereto. Nut 62 is slidably received within the bore of hollow driving part 54. This bore includes an internal shoulder 65; and a washer 66 disposed between nut 62 and shoulder 65 bears against shoulder 65 when the parts are in their position of FIG. 1.

Driven part 52 of the wipe mechanism 50 further comprises an abutment 68 effectively fixed to rod 60 intermediate its ends. The preloaded compression spring 56 bears at its upper end against this abutment 68 and at its lower end against driving part 54.

Closing of the circuit breaker is effected as follows. Operating link 36 is driven to the right from its position of FIG. 1 to rotate bell crank 32 in a counterclockwise direction. When bell crank 32 is thus rotated, it imparts upward motion to driving part 54, and such upward motion is transmitted to abutment 68 through preloaded wipe spring 56, thus driving movable contact rod 26 upwardly through its closing stroke.

When the contacts 20 and 22 engage near the end of the closing operation, the driven part 52 is blocked from further upward motion, but the driving part 54 continues moving upwardly a short additional distance. This additional distance is depicted at W in FIG. 3 and is referred to herein as wipe travel or wipe. This upward motion of the driving part 54 through this wipe travel W further compresses wipe spring 56, thus increasing the hold-closed force on contacts 20, 22 and compensating in the usual manner for contact-wear.

Opening of the circuit breaker is effected by driving bell crank 32 in a clockwise direction from its position of FIG. 3. This drives part 54 downwardly through wipe travel W, causing shoulder 65 to strike washer 66 on nut 62. The resulting impact is imparted to the movable contact 22 through rods 60 and 26, thus initiating downward opening motion of movable contact 22. Further downward motion of driving member 54 drives part 62, 60, 26, and 22 downwardly through a circuit-breaker opening stroke.

The circuit-breaker opening stroke of driving part 54 is terminated when shoulder 46 on operating link 36 strikes stationary stop 48. I make no attempt to terminate this opening stroke gradually, as with the usual dashpot. The decelerating forces that result from this abrupt termination are so high that the inertia of driven parts 52, 26, 22 continues the downward opening motion of these parts against the opposition of preloaded compression spring 56. The driven part 52, in effect, overruns the driving part 54.

This overrunning action is allowed to continue for a short distance (typically 1/16 to ⅛ inch) but is then terminated by a stop 70 that is then positioned beneath the lowermost end 72 of rod 60. Stop 70 is carried by operating link 36 and is located in a position offset from the axis of said rod 60 when the circuit breaker is in its closed position of FIG. 3. But opening motion of operating link 36 carries this stop 70 into alignment with the axis of rod 60, thus positioning the stop for impingement by the end 72 of rod 60. The amount of overrunning travel is sufficiently limited in value as to prevent damage to the bellows 28 despite thousands of excursions of rod 60 through this overrunning travel.

The stop 70 is carried atop the spacer 37 that is clamped between segments 36a and 36b of link 36. In a preferred embodiment of the invention, this stop comprises a stack of superposed plates bolted to spacer 37 by spaced bolts 75, shown in FIG. 2. The top plate 76 is a metal impact plate against which the end 72 directly impacts at the end of its overrunning motion. Bottom plate 78 is a non-metallic buffer plate for absorbing the impact energy. Intermediate plates 79 and 80 are shims for adjusting the position of impact plate 76 to provide the desired spacing G between parts 72 and 76. A typical material for buffer pate 78 is a nitrile rubber having hardness of 80–85 Shore A Durometer.

It will be apparent that stop 70 consumes little space beyond that required anyway for operating link 36. It will be further apparent that it is a simple matter to adjust the spacing G, since this can be done by simply adding or subtracting shims such as 79 and 80. This stop 70 is readily accessible for such adjustments.

It wil be further apparent that I do not rely upon or require the usual opening dashpot for terminating the opening stroke of the circuit breaker. Even though I abruptly impact the primary stop 48, I can (with the auxiliary stop 70) precisely control the total opening stroke of the movable contact despite overrunning resulting from the abrupt impact.

It will be further apparent that my stop 70 in no way interferes with obtaining the desired wipe travel W at the end of a closing stroke since the stop 70 is spaced from and out of the path of driven part 52 during this interval. In fact, stop 70 is spaced from the entire wipe mechanism 50 during closing.

Figure 4:
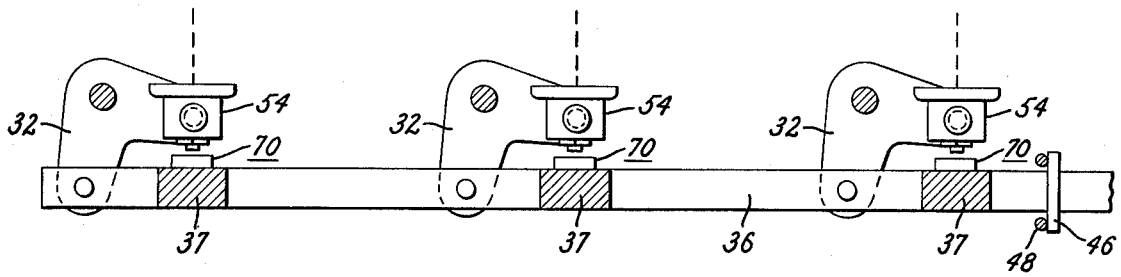
FIG. 4 is a schematic showing illustrating application of the invention to a polyphase circuit breaker.

Although FIGS. 1–3, show only a single phase circuit breaker, it is to be understood that the invention is readily applicable to a polyphase circuit breaker. FIG. 4 shows how the invention is applied to such a circuit breaker. Each phase is substantially identical to that shown in FIGS. 1–3 and comprises its own bell crank, interrupter, and wipe mechanism. The bell crank 32 of each phase is pivotally connected to the operating link 36 at spaced points along its length. Individual stops 70 are provided on the operating link 36 at spaced points and act in the same manner as the above described stop 70 with respect to its associated phase.

It will be apparent that in a three phase circuit breaker, I absorb the opening impact in four separate locations. Distributing the opening impact in this way instead of attempting to absorb it in a single location results in a more uniform stressing of the linkage by the opening impact, thus reducing the chances for possible damaging concentrations of stress.

Figure 5:
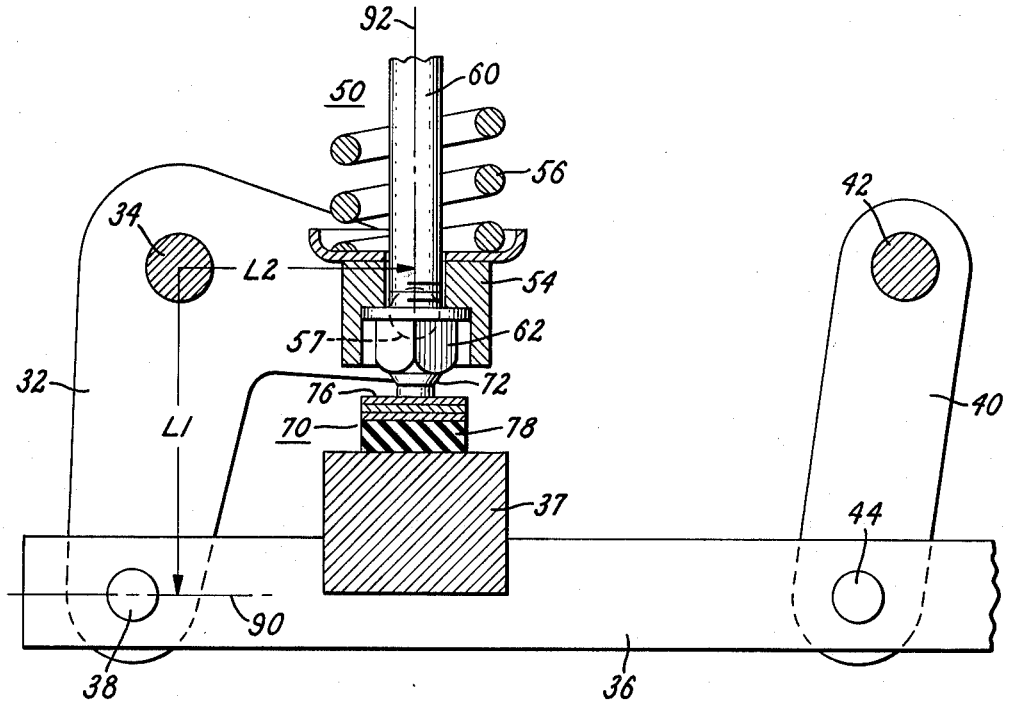
FIG. 5 illustrates a modified form of the invention. The circuit breaker depicted therein is shown at the end of its opening stroke.

FIG. 5 shows a modified form of the invention, where parts corresponding to those of FIG. 1 have been assigned the same reference numerals as in FIG. 1. A basic difference between the embodiment of FIG. 5 and that of FIG. 1 is that in FIG. 5 the primary stop 48 of FIG. 1 has been omitted and the stop 70 is being used as the sole stop for terminating opening motion (assuming a single-phase circuit breaker). During an opening operation, the operating member 36 moves to the left from a position corresponding to that of FIG. 2, entering the position of FIG. 5 near the end of the opening operation.

This leftward opening motion of operating member 36 drives the bell-crank 32 clockwise about stationary fulcrum 34, transmitting downward contact-separating motion to driving part 54. This downward motion of driving part 54 is transmitted to driven part 52 through the nut 62, forcing driven part 52 to move downwardly until its lower end 72 engages the upwardly-facing impact plate 76 of the stop 70. (The driven part 52 is occasionally referred to herein as an actuating part).

The stop 70, since it includes the resilient buffer plate 78, has some yieldability; and this allows a slight additional movement of the operating member 36 to the left following initial impact between lower end 72 and impact plate 76. This additional leftward movement of operating member 36 results in a transverse scrubbing action between the upper surface of plate 76 and the lower end 72 of the driven or actuating part 52. While this scrubbing action is occurring, the lower end 72 is continuing to move downwardly through a slight additional travel, increasing the pressure between parts 72 and 76. This scrubbing action, proceeding as it does under increasing pressure, produces high frictional forces which are very effective in dissipating the remaining opening energy.

Although the energy dissipation of the device of FIG. 5 can be made extremely large, the device is self-adjusting and will return to its relaxed stop position. Coulomb friction forces, while large, are not able to cause the device to "stick" or hang up in an intermediate, or deflected, position of the stop, provided that the arms of the bell crank 32 are properly proportioned, e.g., within the range specified hereinafter.

An analysis of this stop device of FIG. 5 shows that the energy-dissipating effectiveness of the stop device depends to a large extent upon the coefficient of friction between the scrubbing surfaces of parts 72 and 76 and also upon the ratio of the effective lengths L1 and L2 of the arms of bell crank 32. More specifically, this energydissipating effectiveness varies as a direct function of the coefficient of friction and of the ratio L1/L2. (L1 is the effective length of the driving arm, and L2 is the effective length of the driven arm. In more specific terms, L1 is the actual distance between the axis of fulcrum 34 and the line of action 90 of operating member 36 through pivot pin 38, as measured perpendicular to this line of action 90; and L2 is the actual distance between the axis of fulcrum 34 and the line of action 92 of driven member 52 through trunnion 57, as measured perpendicular to this line of action 92.). The ratio L1/L2 is referred to hereinafter as the mechanical advantage of the bell crank.

If the mechanical advantage of the bell crank of FIG. 5 is made less than about one, then the energy-dissipating efficiency of the device of FIG. 5 becomes too low for most applications. On the other hand, if this mechanical advantage is increased substantially beyond about four, there is a pronounced tendency for "sticking" or self-locking of the driven part 52, 72 with respect to the stop 70 after the above-described deflection of the stop. Although I prefer to avoid such sticking in the preferred embodiment, there are applications where a limited amount of such sticking is acceptable, and even desirable since it prevents rebound of the driven part at the end of the opening stroke.

In a polyphase circuit breaker of the general configuration shown in FIG. 4, energy-dissipation as described hereinabove in connection with FIG. 5 can be realized by omitting primary stop 48 of FIG. 4 and modifying one or more, and preferably all, of the stop devices 37, 70 as shown in FIG. 5. This distributes the opening impact between all these energy-dissipators, thus more uniformly stressing the linkage and reducing the chances for possibly damaging concentration of stress.

It is to be understood, with respect to both embodiments, that the yieldability of stop 70 is made sufficient to limit the deceleration rates to values which will prevent damage to the parts of the vacuum interrupter when the part 72 impacts the stop.

While I have shown and described a particular embodiment of my invention, it will be obvious to those skilled in the art that various changes and modifications may be made without departing from my invention in its broader aspects; and I, therefore, intend herein to cover all such changes and modifications as fall within the true spirit and scope of my invention.

What I claim as new and desire to secure by Letters Patent of the United States is:

1. A vacuum-type circuit breaker comprising:

a. an evacuated envelope, b. a pair of separable contacts within said envelope, one of which is movable relative to the other, c. a contact rod extending into said envelope for carrying said one contact, d. a flexible metal bellows connected between said contact rod and said envelope for providing a seal about said contact rod, e. a wipe mechanism comprising:

e1. a driven part coupled to said contact rod, e2. a driving part through which contact operating force is applied to said driven part, and e3. preloaded spring means between said driving and driven parts through which driving force is transmitted from said driving to said driven part during contact-closing motion, said spring means yielding to store energy when said driving part is driven through contact-wipe travel after said contacts engage at the end of a closing operation, f. an operating member movable with respect to said driving part but coupled to said driving part and operable through a closing stroke to transmit closing motion to said one contact through said wipe mechanism; said operating member and said driving part continuing to move through contact-wipe travel after said contacts engage at the end of a closing stroke, thereby storing energy in said spring means, g. said operating member being operable through an opening stroke to drive said driving part against said driven part to impart contact-opening motion to said driven part, h. first stop means for stopping said operating member at the end of its opening stroke with such abruptness that said driven part overruns said driving part following such stopping against the opposition of said preloaded spring means, i. second stop means for limiting overrunning of said driven part with respect to said driving part following said stopping of said driving part comprising a stop carried by said operating member for engaging said driven part and thereby blocking said overrunning after a limited amount of such overrunning sufficiently low to prevent damage to said bellows despite thousands of excursions of said driven part through said overrunning travel, said stop being carried on said operating member in such a location that the stop is spaced from said wipe mechanism during contact-wipe travel at the end of a closing stroke.

2. The vacuum circuit breaker of claim 1 in which:

a. said operating member is movable in a direction extending generally transversely of the path of said driven part during a circuit-breaker opening operation, b. said stop is located in a position offset from said path movement of said driven part when said circuit breaker is closed, and c. said stop is moved into a position aligned with said path of movement by motion of said operating member during a circuit-breaker opening stroke.

3. The vacuum circuit breaker of claim 1 in which said stop comprises:

a. resilient energy-absorbing structure, and b. metallic structure mounted on said resilient structure and adapted to be engaged by a portion of said driven part at the end of said overrunning motion.

4. The vacuum circuit breaker of claim 1 in which said resilient energy-absorbing structure is non-metallic.

5. A polyphase circuit breaker as defined in claim 1 in which one phase thereof is constructed as defined in (a) through (e) of claim 1 and additional phases are constructed in a corresponding manner, said operating member of claim 1 being coupled to the driving part of each additional phase and cooperating with said additional phases in the same manner as defined in (f) through (h) of claim 1, said circuit breaker further comprising additional stops carried by said operating member for respectively engaging the driven parts of said additional phases when said driven parts overrun their respective driving parts at the end of an opening stroke and thereby blocking overrunning of said driven parts after a limited amount of such overrunning sufficiently low to prevent damage to their associated bellows despite thousands of excursions of said driven parts through said overrunning travel.

6. An electric circuit breaker comprising:

a. a pair of separable contacts, b. an actuating part coupled to one of said contacts and movable along a first predetermined path to effect separation of said contacts, c. an operating member for said actuating part movable along a second predetermined path extending transversely of said first path, d. coupling means for coupling said operating member to said actuating part so that opening motion of said operating member acts through said coupling means to impart contact-separating motion to said actuating part, and e. yieldable stop means including a stop carried by said operating member and having an impact surface for engaging said actuating part near the end of a circuit-breaker opening stroke, thereby yieldably blocking continued contact-separating motion of said actuating part, said engagement being accompanied by transverse scrubbing action between said actuating part and said impact surface wherein said impact surface moves transversely of said first predetermind path while said actuating pair is being driven against said impact surface by force transmitted from said operating member through said coupling means to said actuating part during said engagement.

7. The circuit breaker of claim 6 in which said coupling means comprises a bell crank having a mechanical advantage of about one or higher.

8. The circuit breaker of claim 6 in which said coupling means comprises a bell crank having a mechanical advantage higher than about one and no higher than about four.

9. The circuit breaker of claim 6 in which continued travel of said operating member in an opening direction after said engagement initially occurs causes said actuating part to be driven with increasing pressure against said impact surface.

10. The circuit breaker of claim 6 in combination with:

a. an additional pair of contacts, b. an additional actuating part coupled to one of said additional contacts and movable along an additional predetermined path to effect separation of said additional contacts, c. additional coupling means for coupling said operating member to said additional actuating part so that opening motion of said operating member acts through said coupling means to impart contact-separating motion to said additional actuating part, and d. additional yieldable stop means including a stop carried by said operating member and having an impact surface for engaging said additional actuating part near the end of a circuit-breaker opening stroke, thereby yieldably blocking continued contact-separating motion of said additional actuating part, said latter engagement being accompanied by transverse scrubbing action between said additional actuating part and said latter impact surface wherein said latter impact surface moves transversely of said additional predetermined path while said additional actuating part is being driven against said latter impact surface by force transmitted from said operating member through said additional coupling means to said additional actuating part during said latter engagement.

* * * * *